US006845168B2

(12) United States Patent
Kuwabara et al.

(10) Patent No.: US 6,845,168 B2
(45) Date of Patent: Jan. 18, 2005

(54) SPEAKER FOR AN ELECTRONIC INSTRUMENT

(75) Inventors: Atsushi Kuwabara, Yamanashi-ken (JP); Yoshizumi Ohta, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 10/409,081

(22) Filed: Apr. 9, 2003

(65) Prior Publication Data

US 2003/0194105 A1 Oct. 16, 2003

(30) Foreign Application Priority Data

Apr. 10, 2002 (JP) ..... 2002-107222

(51) Int. Cl.[7] ..... H04R 25/00

(52) U.S. Cl. ..... 381/409; 381/410; 381/396

(58) Field of Search ..... 381/396, 409, 381/410, 412, 400, 394, 386, 344; 340/391.1, 388.1, 388.5; 379/433

(56) References Cited

U.S. PATENT DOCUMENTS 6,023,518 A * 2/2000 Kuwabara et al. ..... 381/396
6,433,674 B2 * 8/2002 Kuwabara et al. ..... 340/391.1
6,526,152 B2 * 2/2003 Frasl ..... 381/409
6,704,430 B2 * 3/2004 Imahori et al. ..... 381/396

* cited by examiner

*Primary Examiner*—Huyen Le
(74) *Attorney, Agent, or Firm*—Dennison, Schultz, Dougherty & MacDonald

(57) ABSTRACT

A speaker has a frame made of resin, a diaphragm provided in the frame, a voice coil mounted on the diaphragm. A pair of holes are formed under the diaphragm so as to be opened at an underside of the frame. A spring is connecting member provided in each of the holes to be projected from the underside of the frame, and connected to an end of the voice coil.

4 Claims, 3 Drawing Sheets

SPEAKER FOR AN ELECTRONIC INSTRUMENT

BACKGROUND OF THE INVENTION

The present invention relates to a speaker for generating sounds by vibrating a diaphragm.

In recent years, there is a tendency to mount small electric parts on a printed circuit board, an electrodynamic speaker for the small electronic instrument is accordingly mounted on the printed circuit board. Such a printed circuit for the portable telephone is used as a signaling device.

Referring to FIGS. 5, 6 and 7, which are a ton plan view of a conventional electrodynamic speaker, a sectional view taken along a line VI—VI of FIG. 5, and a bottom plan view of the sneaker of FIG. 5, respectively, an electrodynamic speaker 50 has a circular frame 51 having a central circular hole 51*a* and a pair of projection portions 51*d*. An annular shoulder 51*b* is formed on the frame 51 and a cylindrical hole 51*e* is formed in each of the projection Portions 51*d*.

A yoke 52 made of magnetic material and having a dish-shape is secured to the wall of the central hole 51*a*. A disk-shape magnet 53 is secured to the yoke 52 and a disk-shape top plate 54 is securely mounted on the magnet 53. Thus, a magnetic circuit is formed between the yoke 52 and the top plate 54, interposing the magnet 53.

A circular diaphragm 55 made of plastic has a spherical central portion, and a circular recess 55*a* at the periphery of the central portion. An annular voice coil 56 is fixed to the underside of the recess 55*a* and inserted in the gap between the periphery of the top plate 54 and an upper portion of the yoke 52.

A pair of lead plates 57, each of which is made of an elongated metal plate, are embedded in the frame 51. An end of each of the lead plates 57 is connected to the voice coil 56, the other end is inserted in the hole 51*e* of the projection portion 51*d*. A coil spring 58 is inserted in each hole 51*e*. An upper end 58*a* of the coil spring 58 is inserted in a hole formed in an end portion 57*a* of the lead plate 57 and electrically connected to the lead plate 57 by solder. The lower end of the spring 58 is projected from the underside of the frame 51.

Both ends of the coil 56 are soldered to ends of lead plates 57. Thus, the coil 56 is connected to the coil springs 58.

A cover 59 has sound emanating holes 59*a* and is adhered to the shoulder 51*b*. The coil springs 58 are pressed against a circuit pattern on a substrate.

In the conventional speaker, since the projection portions 51*d* are projected from the frame 51, the speaker occupies a larger area. Thus, the projection prevents the speaker from being miniaturized.

SUMMARY OF THE INVENTION

An object of the present invention is to provide a speaker having a small area in plan view.

According to the present invention, there is provided a speaker comprising a frame made of resin, a diaphragm provided in the frame, a voice coil mounted on the diaphragm, a pair of holes formed under the diaphragm so as to be opened at an underside of the frame, and a connecting member provided in each of the holes to be projected from the underside of the frame, and connected to an end of the voice coil.

The connecting member is a spring.

The frame comprises an upper frame and a lower frame, the upper frame has a holding portion extending to an underside of the lower frame, and the holes are formed in the holding portion.

These and other objects and features of the present invention will become more apparent from the following detailed description with reference to the accompanying drawings.

DETAILED DESCRIPTION OF THE PREFERRED EMBODIMENT

Figure 1:
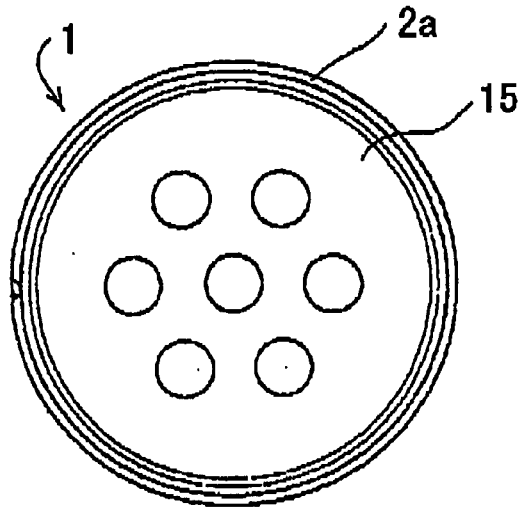
FIG. 1 is a plan view of a speaker of the present invention.
Figure 2:
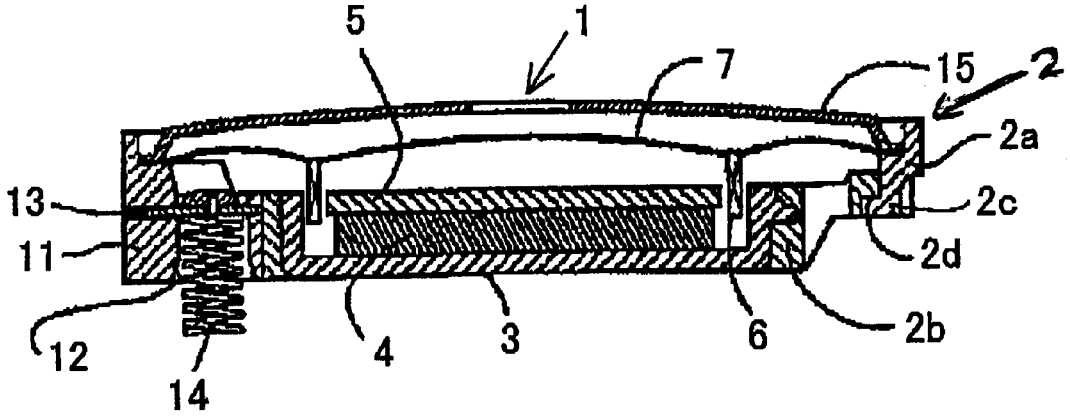
FIG. 2 is a sectional view of the speaker taken along a line II—II of FIG. 3.
Figure 3:
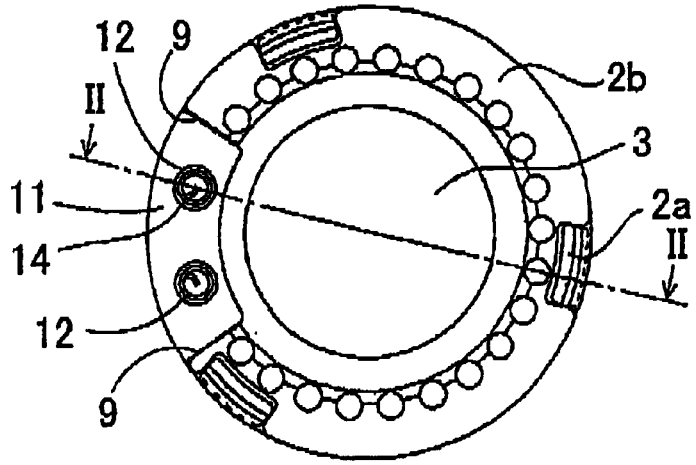
FIG. 3 is a plan view of the speaker as viewed from the underside thereof.

Referring to FIGS. 1 to 3, an electrodynamic speaker 1 has a circular frame 2 made of plastic and comprising an upper frame 2*a* and a lower frame 2*b*, The upper frame 2*a* has a shoulder 2*c* and the lower frame 2*b* has a hook 2*d*, and both frames are adhered at the shoulder 2*c* and hook 2*d*.

A yoke 3 made of magnetic material and having a dish-shape is secured to the lower frame 2*b*. A disk-shape permanent magnet 4 and a disk-shape top plate 5 are stacked on the yoke 3 and secured to each other.

A circular diaphragm 7 made of plastic has a spherical central portion, a circular recess at the periphery of the central portion and a peripheral portion. An annular voice coil 6 is fixed to the underside of the recess and inserted in the gap between the periphery of the top plate 5 and an upper portion of the yoke 3.

The upper frame 2*a* has a downwardly projected holding portion 11 which is disposed in a recess 9 formed in the lower frame 2*b* and extended to the same plane as the underside of the lower frame 2*b* as shown in FIG. 2 and has a semicircular shape in plan view as shown in FIG. 3. In the holding portion 11, a pair of insertion holes 12 are axially formed to be opened at the underside of the holding portion.

A pair of lead plates 13, each of which is made of an elongated metal plate, are embedded in the frame 2. A coil spring 14 is inserted in each hole 12. An upper end of the coil spring 14 is inserted in a hole formed in an end portion of the lead plate 13 and electrically connected to the lead plate 13 by solder. The lower end of the spring 14 is projected from the underside of the frame 2.

Both ends of the voice coil 6 are soldered to ends of lead plates 13. Thus, the coil 6 is connected to the coil springs 14. A cover 15 has sound emanating holes and is adhered to a shoulder of the frame 2 together with the diaphragm 7. The coil springs 14 are pressed against a circuit pattern on a substrate.

Figure 4:
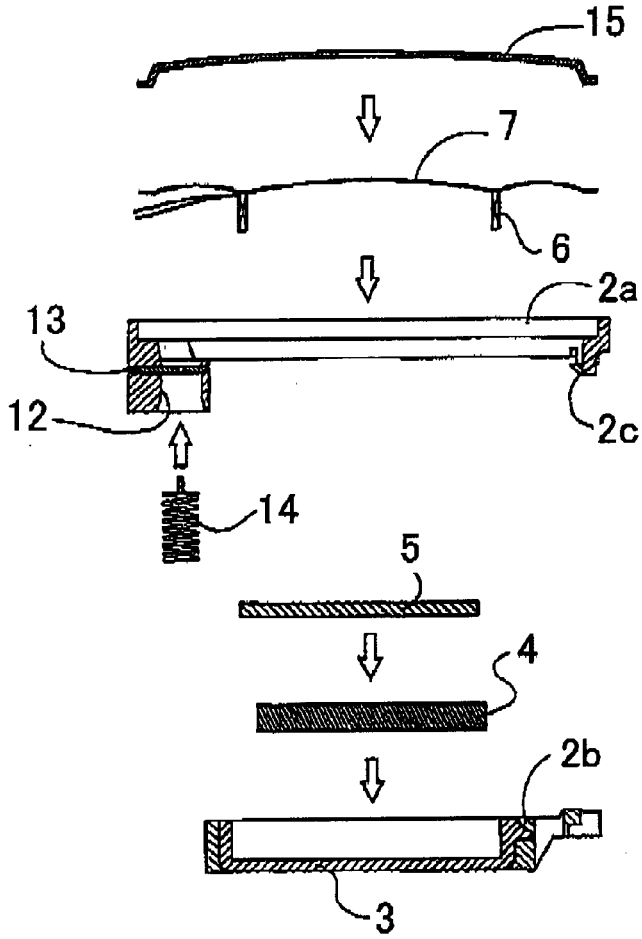
FIG. 4 is a sectional view for explaining the assembling of the speaker.
Figure 5:
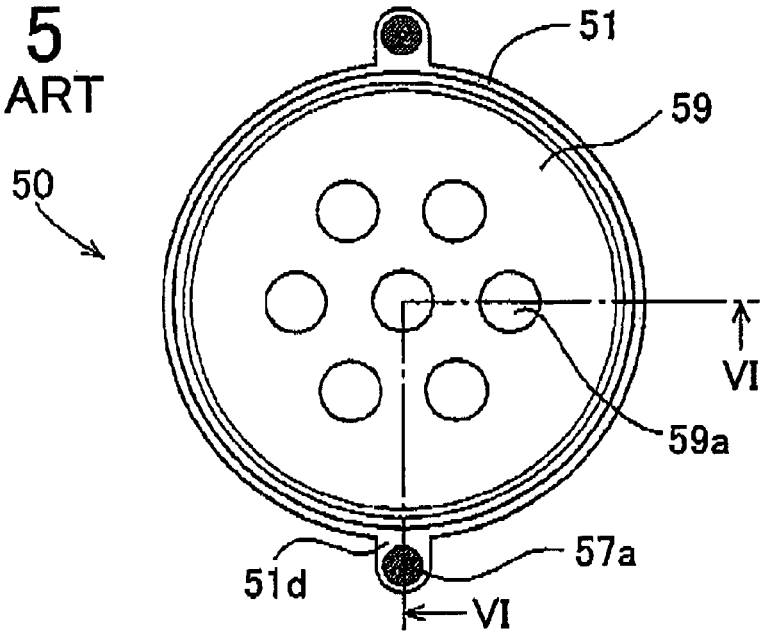
FIG. 5 PRIOR ART
FIG. 5 is a plan view of a conventional electrodynamic speaker.
Figure 6:
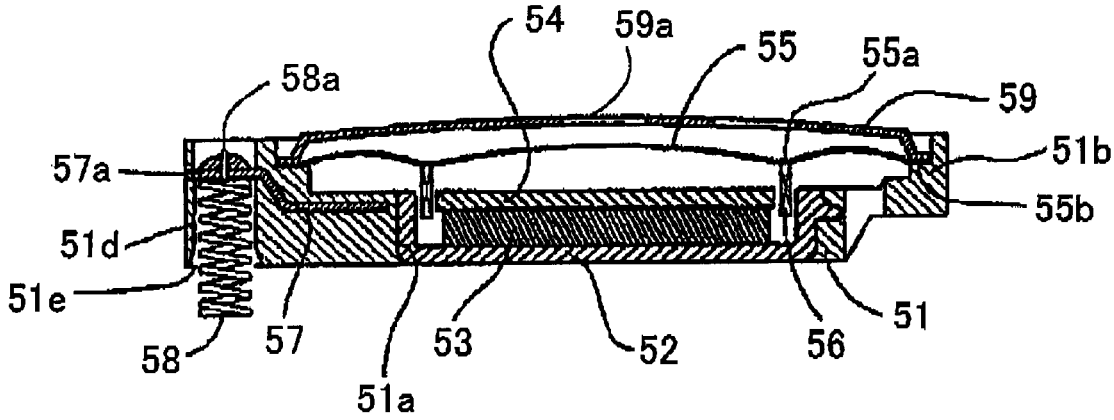
FIG. 6 PRIOR ART
FIG. 6 is a sectional view taken along a line VI—VI of FIG. 5.
Figure 7:
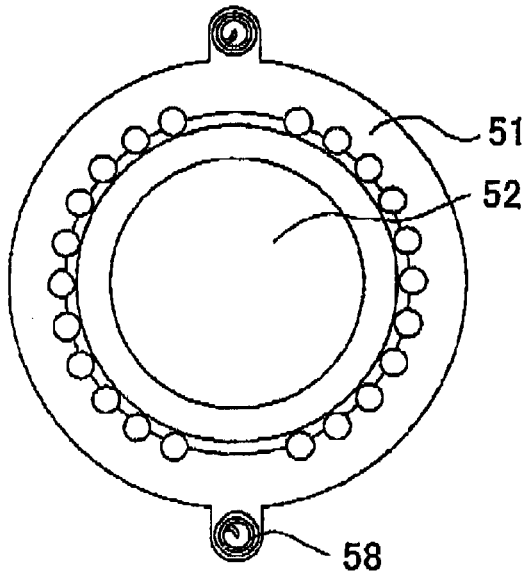
FIG. 7 PRIOR ART
FIG. 7 is a plan view as viewed from the underside thereof.

The method for assembling the speaker is described hereinafter with reference to FIG. 4. The lead plate 13 is preliminarily embedded in the upper frame 2*a*. The diaphragm 7 to which a voice coil 6 is secured is fixed to the upper frame, on which the cover 15 is adhered. Next, both ends of the voice coil 6 are soldered to exposed ends of the lead plates 13. Each coil spring 14 is inserted in the insertion hole 12, and the end of the spring 14 is soldered to the end of the lead plate.

The yoke 3 is embedded in the lower frame 2*b*. The permanent magnet 4 is adhered to the yoke, and the top plate 5 is adhered to the magnet 4. Lastly, the upper and lower frames are secured at the shoulder 2*c* and hook 2*d*.

In accordance with the present invention, there is not provided projection portions outwardly projected from the frame of the speaker. Therefore, the speaker does not occupy a large area, thereby reducing the size of an electronic instrument to be provided with the speaker.

While the invention has been described in conjunction with preferred specific embodiment thereof, it will be understood that this description is intended to illustrate and not limit the scope of the invention, which is defined by the following claims.

What is claimed is:

1. A speaker comprising:

a frame made of resin and having a circular outside wall in plan view;

a circular diaphragm provided in the frame;

a voice coil mounted on the diaphragm;

a pair of holes formed and opened at an underside of the frame and within the diaphragm in plan view; and a connecting member provided in each of the holes with one end of each connecting member projecting from the underside of the frame, and an opposite end of each connecting member connected to an end of the voice coil.

2. The speaker according to claim 1, wherein the connecting member is a coil spring.

3. The speaker according to claim 2, additionally comprising a pair of lead plates, each said lead plate having a first end connected to an end of the voice coil, and an opposite end connected to an end of one said coil spring to form the connection between the connecting member and the voice coil.

4. The speaker according to claim 1, wherein the frame comprises an upper frame and a lower frame, the lower frame having a semicircular recess open at an outside wall of the frame, the upper frame having a holding portion engaged in the recess of the lower frame, and the holes being formed in the holding portion.

* * * * *